US005709352A

United States Patent [19]

Rogers et al.

[11] Patent Number: 5,709,352

[45] Date of Patent: Jan. 20, 1998

[54] ZERO TENSION WEB UNWINDER APPARATUS AND METHOD

[75] Inventors: Jeffery Kane Rogers; Gary Micheal Jackson; Wallace Ray Lassiter; Carl Carlton Greene, Jr., all of Winston-Salem, N.C.

[73] Assignee: R. J. Reynolds Tobacco Company, Winston-Salem, N.C.

[21] Appl. No.: 681,737

[22] Filed: Jul. 29, 1996

[51] Int. Cl.[6] ..... B65H 23/185

[52] U.S. Cl. ..... 242/417.1; 242/418.1; 242/420.3; 242/420.6

[58] Field of Search ..... 242/417.1, 418.1, 242/420.3, 420.6, 421.7

[56] References Cited

U.S. PATENT DOCUMENTS

| | | | |
|---|---|---|---|
| 3,107,870 | 10/1963 | Cetnar | 242/420.6 |
| 3,386,681 | 6/1968 | Waterhouse et al. | 242/421.7 |
| 4,050,642 | 9/1977 | Katsumata et al. | 242/417.1 |
| 4,384,665 | 5/1983 | Waddington | 242/420.6 |
| 4,461,432 | 7/1984 | Hutzenlaub | 242/421.7 |
| 4,498,638 | 2/1985 | Kurtz et al. | 242/417.1 |
| 4,676,447 | 6/1987 | Zald et al. | 242/420.3 |
| 4,804,898 | 2/1989 | Nordlof et al. | 242/418.1 |
| 5,193,424 | 3/1993 | Minichshofer et al. | 242/418.1 |
| 5,362,008 | 11/1994 | Nael et al. | 242/418.1 |
| 5,472,153 | 12/1995 | Crowley et al. | 242/420.3 |
| 5,501,412 | 3/1996 | McAlezvey | 242/417.1 |

FOREIGN PATENT DOCUMENTS

| | | | |
|---|---|---|---|
| 816859 | 7/1959 | United Kingdom | 242/417.1 |

*Primary Examiner*—John M. Jillions

[57] ABSTRACT

An apparatus and method for the tensionless unwinding of a gossamer web of material from a bobbin uses a servo control system connected between the servomotors of a web handling apparatus and a bobbin unwinder for controlling the unwinding speed of the bobbin unwinder in relation to the take-up speed of the web handling apparatus. A pulsed infrared sensor is used to sense the web position in a loop between the unwinder and the web handling apparatus and supply a feedback signal to the servo control system for maintaining the web in a substantially untensioned state. A flow of air is impinged upon the web adjacent the sensor to prevent unwanted web movement due to ambient air currents and other transitory forces on the web.

17 Claims, 1 Drawing Sheet

ZERO TENSION WEB UNWINDER APPARATUS AND METHOD

FIELD OF THE INVENTION

The present invention relates to unwinding apparatus and methods and more particularly to a method of and an apparatus for unwinding material webs wound on a reel or bobbin, especially material webs having relatively low tensile strength and basis weight.

BACKGROUND OF THE INVENTION

Apparatus are known for unwinding strands or webs of material from reels or bobbins with little or no tension on the material so as to minimize damage to the material that may be caused by excessive tensile forces. Typically, such unwinding is accomplished by driving the reel or bobbin at a controlled speed so that the pay-off speed of the material is exactly equal to the take-up speed of the handling apparatus which utilizes the material. In the case of handling apparatus that takes up the material at a constant speed, it is known to increase the rotational speed of the reel or bobbin as the diameter of the material on the reel or bobbin decreases during unwinding so as to maintain substantially no tension in the strand or web.

In some apparatus, the speed control is based on a predetermined relationship between a constant take-up speed and the known rate of change of pay-off speed based on the changing diameter of the material on the reel or bobbin. In other apparatus, the strand or web tension is indirectly measured by contacting a loop in the strand or web with a dancer or other mechanism which senses changes in the position of the strand or web corresponding to a difference between the take-up speed of the handling apparatus and the pay-off speed of the reel or bobbin. This difference is usually used to control the pay-off speed so as to maintain the strand or web in a substantially untensioned state.

In the case of very delicate webs such as thin woven or non-woven webs of fiberglass, melt blown polypropylene or polylactic acid, gauge, paper tissue and other gossamer web materials, the use of dancers or other devices which measure web tension by directly contacting the web can cause tearing, stretching or other damage to the web. Stretching of the web can also result in inaccurate tension measurement which may cause erratic speed control and lead to tearing of the web.

It has also been found that it is difficult to determine the position of a sheer, gossamer web material being unwound from a bobbin with a non-contacting sensor, such as photoelectric cell, infrared sensor or the like. Such gossamer web materials often do not have the reflective surface or other physical characteristics necessary to provide a sufficient signal to operate such non-contacting sensors. Moreover, the very low basis weight of these web materials renders untensioned loops of the web highly susceptible to movement caused by ambient air currents, machine oscillations, or other transitory forces resulting, for example, from machine start-up, shut down or speed changes. Movement of the web by ambient air currents further exacerbates the problem of obtaining accurate position sensing of the web with any sensor that does not contact the web. Without accurate web position information, it is not possible to reliably control the unwinding of a web from a reel or bobbin under zero tension conditions.

SUMMARY OF THE INVENTION

In view of the foregoing limitations and shortcomings of the prior art devices and methods, as well as other disadvantages not specifically mentioned above, it should be apparent that there still exist a need in the art for a method and apparatus capable of unwinding sheer, gossamer web materials from a reel or bobbin under zero tension conditions. According to both its method and apparatus aspects, the present invention fulfills that need by the use of an analog photoelectric sensor to accurately determine the position or droop of an untensioned loop of web material without contacting the web. Web position or droop data is transmitted by the analog sensor to a servo control system which accurately controls the pay out or unwinding speed of the bobbin in response to the take-up speed output of an encoder for the master handling apparatus that uses the web, for example, an apparatus for manufacturing cigarette filters made from gathered web materials.

To insure that the web loop is not susceptible to movement from ambient air currents or other force inputs that could cause unwanted movement of the loop and the resultant inaccurate loop position or droop dam being transmitted to the servo control system, a low pressure air stream is directed at the upper surface of the web from an air nozzle or diffuser. Preferably, the air nozzle is located adjacent the sensor position and flows the air stream transversely across the web from edge to edge. The pressure of the air stream flowing from the nozzle may be adjusted so as to provide just enough downward force on the web to overcome the effects of any ambient air currents or other forces. Because the air flow resistance of different web materials may vary widely, the pressure of the air stream may also be adjusted to accommodate the air flow resistance of different types of sheer web materials.

The apparatus and method of the present invention are advantageously and especially suited for use in connection with the unwinding of gossamer webs of non-woven materials, such as polypropylene, polylactic acid and other polymeric materials for making cigarette filters. Conventional cigarette filter making equipment, such as a KDF filter maker made by Korber AG of Hamburg, Germany, employs complex mechanical devices and drives for operating the equipment. Typically, machine motion has been achieved with one large motor and gearbox coupled to an output shaft with belt and pulley or chain and sprocket drives. Servo control of the present invention significantly reduces the complexity of the conventional KDF apparatus, enables the use of smaller drive motors directly coupled to the driven machine components and maintains more precise timing or speed correlation among the different machine components.

With the foregoing and other advantages and features of the invention that will become hereinafter apparent, the nature of the invention may be more clearly understood by reference to the following derailed description of the invention, the appended claims and the views illustrated in the drawings.

DETAILED DESCRIPTION OF THE INVENTION

Figure 1:
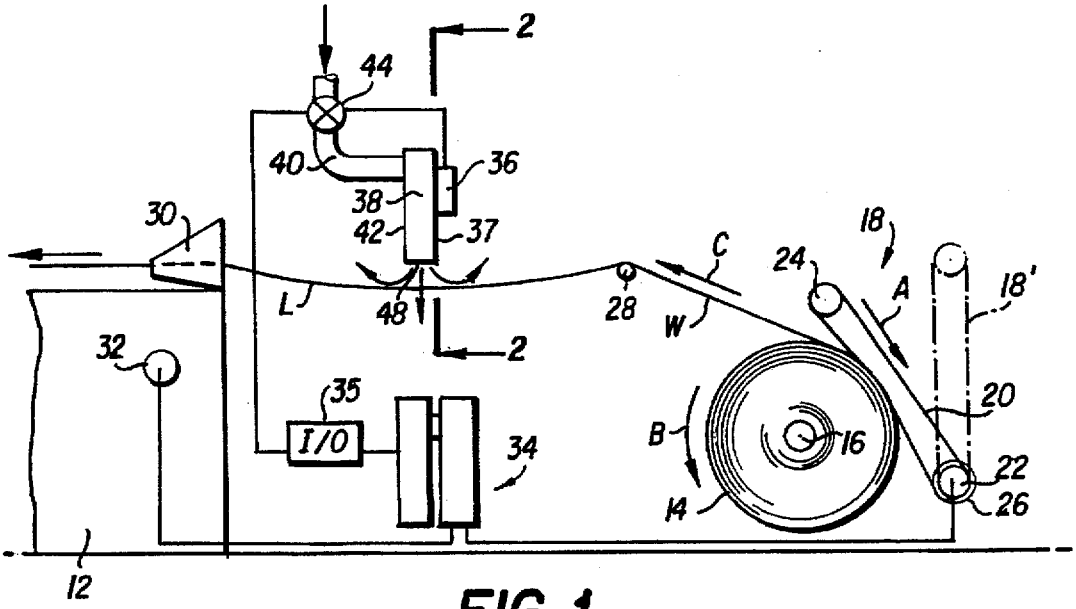
FIG. 1 is a side elevation view, partly schematic, of the apparatus of the present invention shown in connection with a KDF cigarette filter making apparatus.

Referring now in detail to the drawings, FIG. 1 illustrates a preferred embodiment of the apparatus 10 of the invention used in connection with a modified KDF filter maker 12. In this embodiment, a gossamer web W of filter material, such as, for example, a melt blown polypropylene web, is unwound from a roll or spool 14 of the material wound on a bobbin 16.

The roll 14 is unwound or payed out by conventional means, such as a tangential friction drive 18, comprising a belt 20 trained about a pair of pulleys 22, 24 and tangentially bearing against the outer periphery of the roll 14. Pulley 22 is coupled to a servomotor 26 which rotates the pulley 22 in a clockwise direction so as to drive the belt in the direction shown by the arrow A. Friction between the belt 20 and the roll 14 unwinds the roll in a counterclockwise direction shown by arrow B and pays out web W toward the KDF apparatus 12 in the direction shown by arrow C. The friction drive is shown in phantom lines in FIG. 1 in its disengaged position for bobbin loading and is designated by reference numeral 18'. It will be appreciated by those skilled in the art that the roll 14 may be unwound by other means. For example, the bobbin 16 may be directly driven by a servomotor, such as servomotor 26, mounted to the bobbin support frame (not shown).

Web W travels generally upwardly over a guide roll or bar 28 and thence to a condenser or gatherer 30 mounted on the KDF filter maker 12 or other web handling apparatus. Between guide roll 28 and the condenser 30 the web W forms a slight catenary or loop L which may span a distance of a meter or more. The droop or displacement of the loop L below a straight line path between the roll 28 and condenser 30 results from the weight of the untensioned web W.

The web W is taken up by the apparatus 12 at a speed which is sensed by an encoder 32 driven by the main drive motor of the apparatus. The encoder may also be a servomotor used to drive the take-up apparatus or may be connected to a servomotor used to drive the apparatus. The encoder 32 and servomotor 26 are part of a servo control system which includes an electronic machine controller 34 which correlates the unwinding speed of the bobbin 16 with the take-up speed of the web handling apparatus, such as the KDF filter maker 12. An especially preferred machine controller is a Bam Series 64 servo controller Model MWTX-8 made by Berkeley Process Control, Inc., 1001 West Cutting Boulevard, Richmond, Calif. 94804.

Because of slippage inherent in the tangential belt drive system 18 and other machine and web variations, it is necessary to adjust the following speed of the servomotor 26 so that the web W can be unwound under substantially zero tension conditions. For this purpose, the position of the web loop L is sensed by an analog sensor 36 mounted above the web W and electrically connected via an input/output (I/O) device 35 to the controller 34.

An especially preferred analog sensor 36 is a photoelectric proximity sensor which operates with a pulsed infrared light beam. This sensor is made by the SICK Optic-Electronic, Inc. Company of Eden Prairie, Minn., and is available under the designation Model WTA 24-P52011. The sensor has a measuring range of about 250 mm to 350 mm from the sensor and a light spot diameter of about 4 mm to 8 mm. It has been found that this particular sensor is capable of accurately sensing the location of a gossamer web, such as a sheer melt blown polypropylene web.

As shown in FIG. 1, the sensor 36 is mounted on one vertical wall 37 of an air nozzle or diffuser 38 fixedly suspended above the loop L at approximately the mid point of the loop L where web droop is maximum. A low pressure air pipe 40 is connected to another vertical wall 42 of the air nozzle and has a valve 44 which may be automatically or manually adjusted to vary the air flow into the nozzle 38.

The sensor 36 is mounted on the wall 37 at a position above the web loop L such that the untensioned, steady state or zero position of the web W is located at the midpoint of the measuring range of the sensor. In the case of the WTA 24-P5201 sensor described above, the midpoint of the 100 mm measuring range (250 mm–350 mm) is about 300 mm (12 inches) from the sensor.

Figure 2:
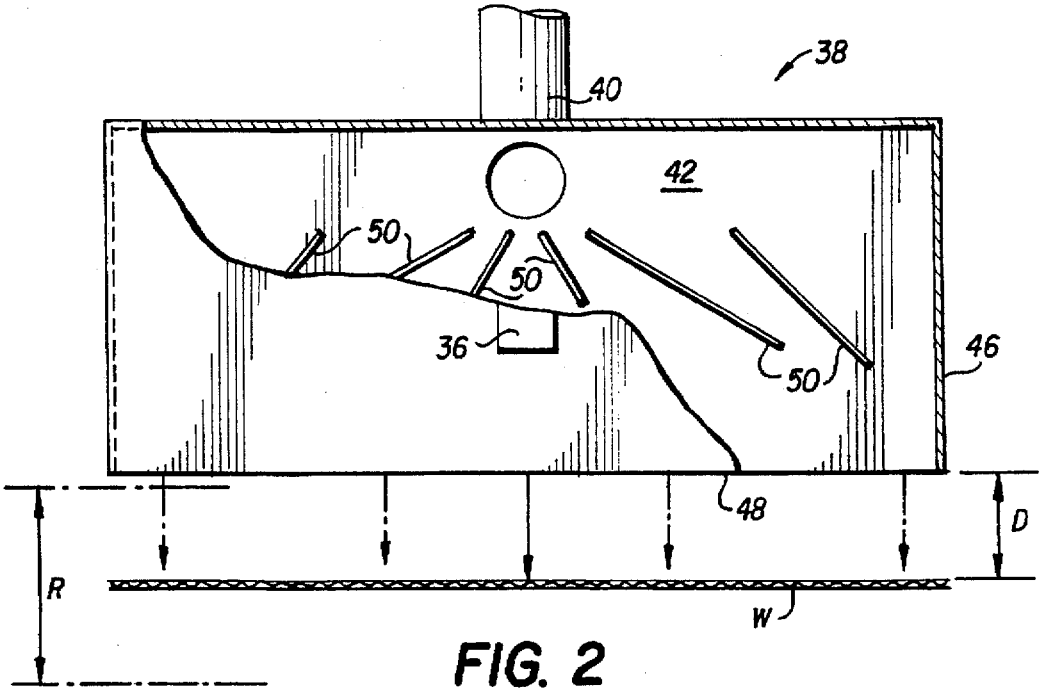
FIG. 2 is a partly-broken cross-sectional view taken along line 2—2 of FIG. 1 showing an embodiment of the air nozzle or diffuser of the present invention.

Referring now to FIG. 2, the air nozzle 38 is shown as a generally rectangular open bottomed box 46 disposed with its air outlet 48 at a distance D above the zero position of the web W. A plurality of baffle plates 50 is arranged inside the box 46 to distribute the air flowing into the box from pipe 40 across the transverse width of the air outlet 48 for a purpose to be described. As shown in FIG. 2, the zero position of the web W is located at approximately the midpoint of the measuring range R of the sensor 36. As also shown in FIG. 2, the sensor 36 is located so that measuring range R is disposed below the bottom of the nozzle 38 so that the nozzle does not interfere with operation of the sensor 36 over its entire measuring range.

It will be appreciated by those skilled in the art that the air nozzle 38 may be constructed in many different forms. For example, the box 46 may have triangular walls and the walls may be tapered toward the air outlet 48 to concentrate the air flow. The baffles 50 may also vary in shape and number. So long as the air flow from air outlet 48 is of a sufficient magnitude and is reasonably uniformly distributed across the transverse width of the outlet, the construction of the nozzle is not critical.

The air flow from outlet 48 impinges on the upper surface of the web W in close proximity to the point of maximum deflection or droop of the loop L. This air flow is adjusted with valve 44 to apply a slight downward force to web W so that ambient air currents and other transitory forces on the web do not cause unwanted movement of the web that would generate errors in the electronic feedback signal from the sensor 36 to the controller 34.

The apparatus of the present invention is suitable for use with webs of varying width and composition and with web handling and utilization apparatus other than the KDF filter maker described herein.

Although certain presently preferred embodiments of the present invention have been specifically described herein, it will be apparent to those skilled in the art to which the invention pertains that variations and modifications of the various embodiments shown and described herein may be made without departing from the spirit and scope of the invention. Accordingly, it is intended that the invention be limited only to the extent required by the appended claims and the applicable rules of law.

We claim:

1. Apparatus for the substantially tensionless unwinding of gossamer web materials wound on a bobbin comprising:

means supporting the bobbin for rotation;

means for rotating the bobbin in a direction to unwind the web therefrom;

a web handling means located downstream of the bobbin supporting means for taking up said web, said web handling means having means for generating a first output signal corresponding to the take-up speed of the web handling means, said web passing along a path of travel from said bobbin to said web handling means and forming a web loop therebetween;

sensor means disposed in non-contacting, spaced relation to the web loop along said path of travel for sensing the position of the web loop, said sensor means having a second output signal corresponding to the position of the web loop;

control means for receiving the first and second output signals and for transmitting a control signal generated based on the first and second output signals to said rotating means so as to rotate said bobbin at a speed sufficient to maintain said web in a substantially tensionless state; and means for impinging a low pressure air stream on said web loop adjacent the sensor means.

2. The apparatus of claim 1, wherein said sensor means comprises a pulsed infrared proximity sensor having a measuring range.

3. The apparatus of claim 1, wherein said rotating means and said signal generating means comprise servo motors and said control means comprises a servo control system.

4. The apparatus of claim 1, wherein said rotating means comprises a tangential belt drive driven by a servo motor, said belt drive frictionally engaging the web wound on said bobbin.

5. The apparatus of claim 1, wherein said air stream impinging means comprises an air nozzle located above said web loop, said air nozzle having an outlet extending transversely with respect to the direction of travel of the web.

6. The apparatus of claim 1, including means for adjusting the pressure of the air stream impinging on the web.

7. The apparatus of claim 1, wherein said web handling means is a cigarette filter maker.

8. The apparatus of claim 5, wherein said sensor means is located above said web loop and has a measuring range, the outlet of said air nozzle being disposed above the measuring range of the sensor means.

9. The apparatus of claim 5, including baffles in the air nozzle for distributing the air stream transversely across the web.

10. Apparatus for the substantially tensionless unwinding of a web of cigarette filter material wound on a bobbin comprising:

means supporting the bobbin for rotation;

a servomotor for rotating the bobbin in a direction to unwind the web therefrom;

a cigarette filter maker located downstream of the bobbin supporting means for taking up said web and forming a cigarette filter from said web, said maker having a web take-up speed;

an encoder on said maker for generating a first output signal corresponding to the web take-up speed of the maker, said web passing along a path of travel from said bobbin to said maker and forming a web loop therebetween;

a sensor disposed in spaced, non-contacting relation to the web loop along the path of travel of the web for sensing the position of the web loop, said sensor having a second output signal corresponding to the position of the web loop in relation to the location of the sensor; and a servo control system responsive to the first and second output signals for producing a control signal based on the first and second output signals and for transmitting the control signal to the servomotor so as to rotate said bobbin at a speed to maintain the web in a substantially tensionless state.

11. The apparatus of claim 10, wherein the sensor is a pulsed infrared sensor having a given measuring range.

12. The apparatus of claim 10, including an air nozzle disposed above said web loop adjacent the sensor for impinging a flow of air transversely across the upper surface of the web loop, said air nozzle having an outlet at the bottom thereof and means for controlling the air pressure admitted to said air nozzle.

13. The apparatus of claim 10, wherein said web is a lightweight gossamer web of melt blown polypropylene.

14. A method for the substantially tensionless unwinding of gossamer web materials wound on a bobbin comprising:

rotating the bobbin in a direction to unwind the web therefrom;

taking up said web on a handling apparatus at a take-up speed;

passing said web along a path of travel from said bobbin to said handling apparatus and forming a web loop therebetween;

generating a first output signal corresponding to the take-up speed of the handling apparatus;

sensing the position of the web loop with a sensor disposed in a non-contacting, spaced relation to the web loop along said path of travel;

generating a second output signal from said sensor corresponding to the position of the web loop;

controlling, in response to the first and second output signals, the speed of rotation of said bobbin so as to maintain said web in a substantially tensionless state; and impinging a low pressure air stream on said web loop adjacent the sensor.

15. The method of claim 14, including the step of adjusting the pressure of the air stream impinging on the web.

16. The method of claim 14, wherein said sensing step includes sensing the position of the web loop using a pulsed infrared light beam.

17. The method of claim 14, wherein said rotating step includes the step of rotating said bobbin with a servomotor.

* * * * *